US009827611B2

(12) United States Patent
Malik et al.

(10) Patent No.: US 9,827,611 B2
(45) Date of Patent: Nov. 28, 2017

(54) DIAMOND COMPOSITE CUTTING TOOL ASSEMBLED WITH TUNGSTEN CARBIDE

(71) Applicant: DIAMOND INNOVATIONS, INC., Worthington, OH (US)

(72) Inventors: Abds-Sami Malik, Westerville, OH (US); Thomas Charles Easley, Bexley, OH (US); Stephen Allen Kaiser, Lupton, MI (US); Torbjorn Selinder, Bandhagen (SE)

(73) Assignee: DIAMOND INNOVATIONS, INC., Worthington, OH (US)

( * ) Notice: Subject to any disclaimer, the term of this patent is extended or adjusted under 35 U.S.C. 154(b) by 0 days.

(21) Appl. No.: 14/610,431

(22) Filed: Jan. 30, 2015

(65) Prior Publication Data

US 2016/0221082 A1 Aug. 4, 2016

(51) Int. Cl.

| | |
|---|---|
| ***B22F 7/00*** | (2006.01) |
| ***B22F 7/08*** | (2006.01) |
| ***B24D 99/00*** | (2010.01) |
| ***B24D 18/00*** | (2006.01) |

(52) U.S. Cl.

CPC ..... *B22F 7/08* (2013.01); *B22F 7/008* (2013.01); *B24D 18/00* (2013.01); *B24D 99/005* (2013.01)

(58) Field of Classification Search

CPC ... B32B 5/00; B01J 2203/00; B01J 2203/062; B24D 18/0009; E21B 10/00; B22F 7/00

See application file for complete search history.

(56) References Cited

U.S. PATENT DOCUMENTS

| | | | | |
|---|---|---|---|---|
| 5,010,043 | A | 4/1991 | Ringwood | |
| 5,288,297 | A | 2/1994 | Ringwood | |
| 6,260,640 | B1 | 7/2001 | Einset et al. | |
| 6,685,880 | B2 | 2/2004 | Engstrom | |
| 7,368,079 | B2 | 5/2008 | Yao et al. | |
| 7,470,341 | B2 | 12/2008 | Keshavan et al. | |
| 8,770,324 | B2 | 7/2014 | Smith et al. | |
| 2008/0206576 | A1* | 8/2008 | Qian | B24D 3/10 428/446 |
| 2009/0301789 | A1* | 12/2009 | Smith | B22F 3/1017 175/374 |

* cited by examiner

*Primary Examiner* — Pegah Parvini
(74) *Attorney, Agent, or Firm* — Corinne R. Gorski

(57) ABSTRACT

A tool and a method of making the tool are disclosed. The tool includes a superabrasive compact, for example, a volume of silicon carbide diamond bonded composite, directly bonded to a tungsten carbide body during sintering. The green body may have a recess with a complementary shape to the superabrasive compact, whereby after inserting at least a part of the superabrasive compact within the recess and sintering, the tungsten carbide body and the recess shrink to form an interference fit therebetween.

14 Claims, 13 Drawing Sheets

DIAMOND COMPOSITE CUTTING TOOL ASSEMBLED WITH TUNGSTEN CARBIDE

TECHNICAL FIELD AND INDUSTRIAL APPLICABILITY

The present disclosure relates to a cutting tool having a superabrasive compact and its method of making, and more particularly, to a method of joining silicon carbide diamond bonded composite to cemented tungsten carbide body without any additional attachment material therebetween.

SUMMARY

In one embodiment, a tool may include at least one superabrasive compact having an outer profile and a tungsten carbide body having a shape that matches at least a part of the superabrasive compact profile directly bonded to the at least one superabrasive compact without any additional attachment material therebetween.

In another embodiment, a method includes the steps of forming a tool by joining a superabrasive compact to cemented tungsten carbide body, providing at least one superabrasive compact having a profile, providing a tungsten carbide green body having at least one recess, wherein the recess has a shape complementary to the profile of the superabrasive compact, positioning at least part of the at least one superabrasive compact into a respective recess to form an assembly, sintering the assembly, and simultaneously shrinking the tungsten carbide and recess to form an interference fit therebetween, wherein no additional attachment material is present between the tungsten carbide body and the superabrasive compact.

In yet another embodiment, a tool includes at least one volume of silicon carbide diamond bonded composite having an outer profile and a tungsten carbide body having a shape that matches at least a part of the silicon carbide diamond bonded composite profile directly bonded to the at least one volume of silicon carbide diamond bonded composite without any additional attachment material therebetween.

The foregoing summary, as well as the following detailed description of the embodiments, will be better understood when read in conjunction with the appended drawings. It should be understood that the embodiments depicted are not limited to the precise arrangements and instrumentalities shown.

DETAILED DESCRIPTION

Figure 1B:
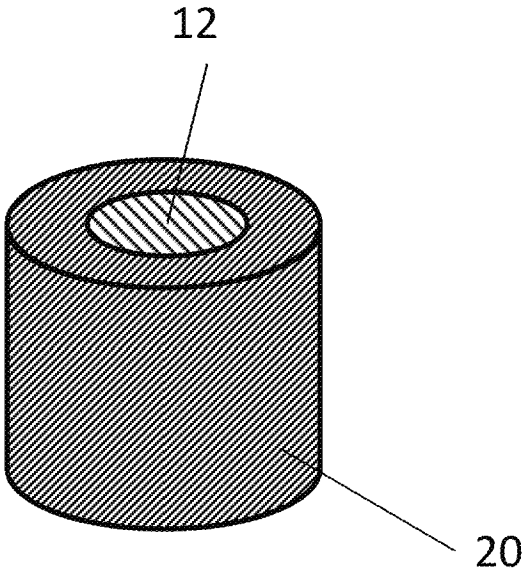
FIGS. 1A and 1B are perspective views of a first embodiment of the present disclosure.

Before the embodiments, terminology, methodology, systems, and materials are described; it is to be understood that this disclosure is not limited to the particular terminologies, methodologies, systems, and materials described, as these may vary. It is also to be understood that the terminology used in the description is for the purpose of describing the particular versions of embodiments only, and is not intended to limit the scope of embodiments. For example, as used herein, the singular forms "a," "an," and "the" include plural references unless the context clearly dictates otherwise. In addition, the word "comprising" as used herein is intended to mean "including but not limited to." Unless defined otherwise, all technical and scientific terms used herein have the same meanings as commonly understood by one of ordinary skill in the art.

As used herein, the term "superabrasive particles" may refer to ultra-hard particles or superabrasive particles having a Knoop hardness of 3500 KHN or greater. The superabrasive particles may include diamond and/or cubic boron nitride, for example. The term "abrasive", as used herein, refers to any material used to wear away softer material.

The term "particle" or "particles", as used herein, refers to a discrete body or bodies. A particle is also considered a crystal or a grain.

The term "superabrasive", as used herein, refers to an abrasive possessing superior hardness and abrasion resistance. Diamond and cubic boron nitride are examples of superabrasives and have Knoop indentation hardness values of over 3500.

The term "superabrasive compact", as used herein, refers to a sintered product made using superabrasive particles, such as diamond particles or cubic boron nitride particles. The compact may include a support, such as a tungsten carbide support, or may not include a support. The "superabrasive compact" is a broad term, which may include cutting element, cutters, or polycrystalline cubic boron nitride insert.

The term "polycrystalline diamond", as used herein, refers to a plurality of randomly oriented monocrystalline diamond particles, which may represent a body or a particle consisting of a large number of smaller monocrystalline diamond particles of any sizes. Polycrystalline diamond particles usually do not have cleavage planes.

The term "tungsten carbide" or "WC" refers to cemented tungsten carbide in which tungsten carbide particles are held together in a matrix of cobalt. The cobalt matrix may also include other metals such as nickel, chromium, etc.

Polycrystalline diamond composite (or "PDC", as used hereafter) may represent a volume of crystalline diamond grains with embedded foreign material filling the inter-grain space. In one particular case, polycrystalline diamond composite comprises crystalline diamond grains, bonded to each other by strong intraparticle bonds and forming a rigid polycrystalline diamond body, and the inter-grain regions, disposed between the bonded grains and filled with a catalyst material (e.g. cobalt or its alloys), which was used to promote chemical bonding of the diamond during fabrication. Suitable metal solvent catalysts may include the metal in Group VIII of the Periodic table. PDC cutting element (or "PDC cutter", as is used hereafter) comprises an above mentioned polycrystalline diamond body attached to a suitable support substrate, e.g., cobalt cemented tungsten carbide (WC—Co), by the virtue of the presence of cobalt metal. In another particular case, polycrystalline diamond composite comprises a plurality of crystalline diamond grains, which are not bonded to each other, but instead are bound together by foreign bonding materials such as borides, nitrides, carbides, e.g. SiC.

Hard polycrystalline diamond composites can be fabricated by forming a mixture of diamond powder with silicon powder and placing it in contact with solid silicon, then subjecting the mixture to high pressure, high temperature (HPHT) conditions. Under HPHT conditions, the silicon melts and reacts with diamond to form SiC, thus forming a dense polycrystalline cutter where diamond particles are bound together by newly formed SiC material. Diamond composites made using this method are often called "silicon carbide bonded diamond composites."

Tools made from silicon carbide bonded diamond composites, such as Versimax® (produced by Diamond Innovations, Inc., Worthington, Ohio), disclosed in U.S. Pat. No. 5,288,297 (column 3, lines 25-68, herein incorporated by reference) and U.S. Pat. No. 5,010,043 (column 5, line 25-column 9, line 26, herein incorporated by reference) and assigned to the assignee of the present invention, have been lab tested and shown to have superior performance to tungsten carbide materials. However, in order to make tools, diamond inserts must be attached to tungsten carbide holders.

Common attachment methods may include, for example, furnace brazing, induction brazing, or microwave brazing used in conjunction with 'active' or 'non-active' brazing alloys. The 'active' brazing alloys are so called because the braze material chemically reacts with the materials to be joined and thus forms a chemical bond between two dissimilar materials. In contrast, a 'non-active' brazing alloy does not chemically react with the materials. In order to use a 'non-active' braze alloy, the Versimax must first be coated, for example, by metals, metal carbides, or mixtures of metal and metal carbides, prior to brazing.

The materials used for brazing silicon carbide diamond bonded composite to tungsten carbide may be costly, especially in the case of 'active' braze alloys. They may be prone to defects because the braze alloy may not completely fill the join between the silicon carbide diamond bonded composite and tungsten carbide. In the case of 'active' braze alloys, specially designed furnaces, in which the atmosphere has been purified to part per million (ppm) levels of oxygen and water, must be used. This is because the 'active' braze alloy is chemically reactive and can react with oxygen and water in preference to the materials to be joined. Such furnaces can be costly to operate.

Rather than attaching a suberabrasive compact, for example, silicon carbide diamond bonded composite, to tungsten carbide, the present disclosure forms the tungsten carbide such that the tungsten carbide and silicon carbide diamond bonded composite are directly joined without the use of any braze alloy or other joining/attachment material. The tungsten carbide is normally first formed as a solid 'green body,' containing tungsten carbide particles, cobalt, and an organic binder. The green body has sufficient strength to maintain its shape for handling. The green body is subsequently sintered at temperatures up to about 1500° C. to form the finished product. It should be appreciated that a sintering temperature range of about 1360° to about 1460° C. can be used, depending on the material composition.

The sintering process removes the organic binder and reacts the tungsten carbide particles and cobalt to form the finished product. During the sintering process, the tungsten carbide green body shrinks in a controlled fashion. This shrinkage process is well known and can be well controlled.

The present disclosure uses this known shrinkage to sinter the tungsten carbide green body such that it forms around the silicon carbide diamond bonded composite. The shrinkage forms an interference fit of the tungsten carbide around the silicon carbide diamond bonded composite, thus eliminating any need for other joining materials. Accordingly, the tungsten carbide is formed in one step to fit the dimensions of the silicon carbide diamond bonded composite part thus eliminating any secondary step to join the materials.

Figure 1A:
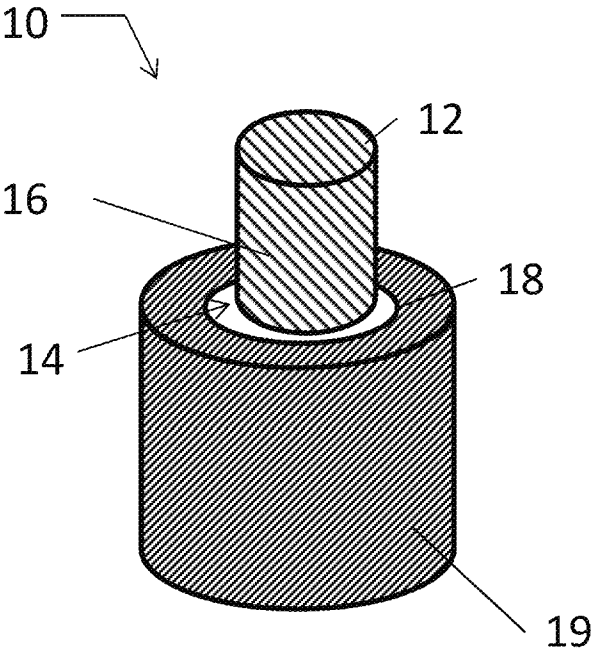

Referring to FIGS. 1A and 1B, a tool 10 is formed by a superabrasive compact 12 that is received within a recess 14 of a tungsten carbide body 19, 20. Superabrasive compact 12 has an outer profile 16. In the present embodiment, superabrasive compact 12 has a cylindrical outer profile. As mentioned herein, superabrasive compact 12 can have a variety of shapes/outer profiles and is not limited to the embodiments described herein.

Tool 10 can be incorporated in at least one of a drill bit, a shear bit, a percussion bit, a roller cone bit, a mining pick, a trenching pick, a road planing pick, an excavating pick, a mill, a hammer mill, a cone crusher, a jaw crusher, and a shaft impactor. It should be appreciated that other types of applications are contemplated by the present disclosure.

Superabrasive compact 12 can be a polycrystalline diamond, polycrystalline cubic boron nitride or silicon carbide diamond bonded composite. Superabrasive compact 12 can be wear resistan part, such as a wear pad, button or a wear plate. It should also be appreciated that the compact can be made of other materials depending on the tool's end use. As shown in FIG. 1B, superabrasive compact 12, for example, a silicon carbide diamond bonded composite, is inserted into recess 14. Recess 14 has a shape 18 that corresponds to outer profile 16 of superabrasive compact 12. Accordingly, when superabrasive compact 12 is located within recess 14 of a tungsten carbide body 20 the outer profile 16 and shape 18 of recess 14 correspond.

In FIG. 1A, tungsten carbide body 19 has not been sintered, and the inner diameter of tungsten carbide body 19 is larger than the outer profile 16 of the superabrasive compact 12 to maintain recess 14. After sintering, as shown in FIG. 1B, tungsten carbide body 20 has shrunk and recess 14 is eliminated, whereby outer profile 16 of superabrasive compact 12 is effectively joined to the tungsten carbide body 20 by a direct interference fit without any additional joining/attachment material therebetween. An interference fit of, but not limited to about 0.005 inches to about 0.01 inches evaluated diametrically may be used. The magnitude of the interference fit at room temperature is greater than a magnitude of a shrink fit between the superabrasive compact 12 and the tungsten carbide body 20 caused by the mismatch in the coefficient of thermal expansion between the superabrasive compact 12 and the tungsten carbide body 20. The interference fit between the sintered tungsten carbide body 20 and the superabrasive compact 12 provides sufficient force to overcome any expected push-out force that would be applied to the superabrasive compact 12 in the tool's application. It should be appreciated that the actual size & shape will determine the amount of interference required.

As discussed above, the sintering shrinkage is in addition to the coefficient of thermal expansion (CTE) mismatch interference of the WC and the superabrasive material. Shrink fitting of Versimax into WC is difficult because of the very small CTE of the WC. The WC sintering shrink provides additional interference fit than would otherwise be present from CTE mismatch in bringing the materials down from the WC sintering temperature. For example, the CTE of Versimax is 1.7 microns/meter and WC is 5.5 microns/meter. The sinter bond produces a compressive bond to the VM due to combination of sinter shrinkage and CTE.

Tungsten carbide body 19 is a green body that is shaped to match the superabrasive compact 12. Upon sintering, the inner diameter of the tungsten carbide green body will shrink in a controlled fashion to form body 20. Upon completion of the sintering cycle, the inner diameter of the tungsten carbide body 20 will match the outer diameter of profile 16 of superabrasive compact 12 such that an interference fit is formed.

Figure 2B:
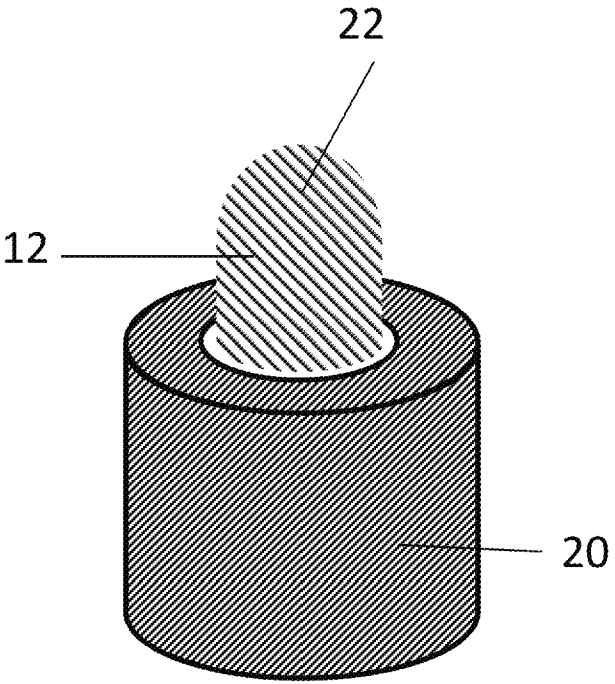
FIGS. 2A and 2B are perspective views of another embodiment of the present disclosure.
Figure 2A:
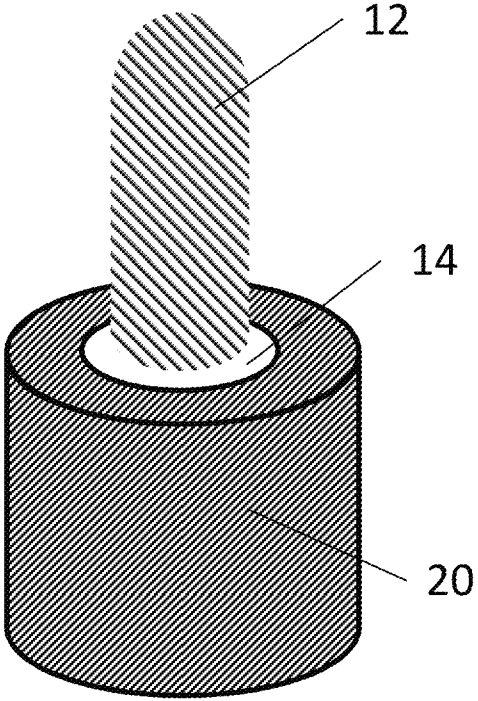

FIGS. 2A and 2B illustrate another embodiment wherein superabrasive compact 12 is in the shape of a mining pick that extends out of the tungsten carbide body 20 after sintering. As shown in FIG. 2A, only a part of superabrasive compact profile 16 is received within recess 14 of tungsten carbide body 20. Accordingly, a proximal end 22 of superabrasive compact 12 projects from tungsten carbide body 20. Proximal end 22 can have a conical or parabolic shape, or any shape that may be useful for the tool's application.

Figure 3B:
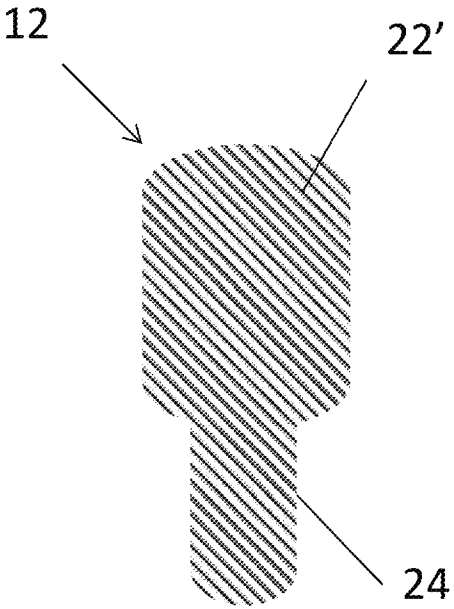
FIGS. 3A and 3B are perspective views of other embodiments of the present disclosure.
Figure 3A:
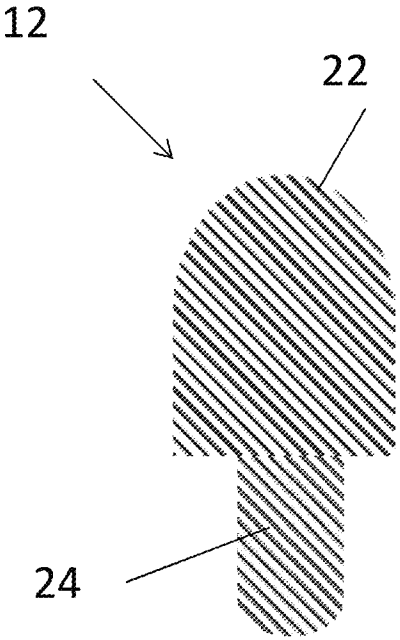

It also should be appreciated that only the part of superabrasive compact 12 that is received within tungsten carbide body 20 needs to have an outer profile that corresponds or matches the shape of the inner diameter of tungsten carbide body. Hence, superabrasive compact 12 can have different shaped profiles at proximal end 22 or a bottom distal end 24, as shown in FIGS. 3A and 3B.

Figure 4:
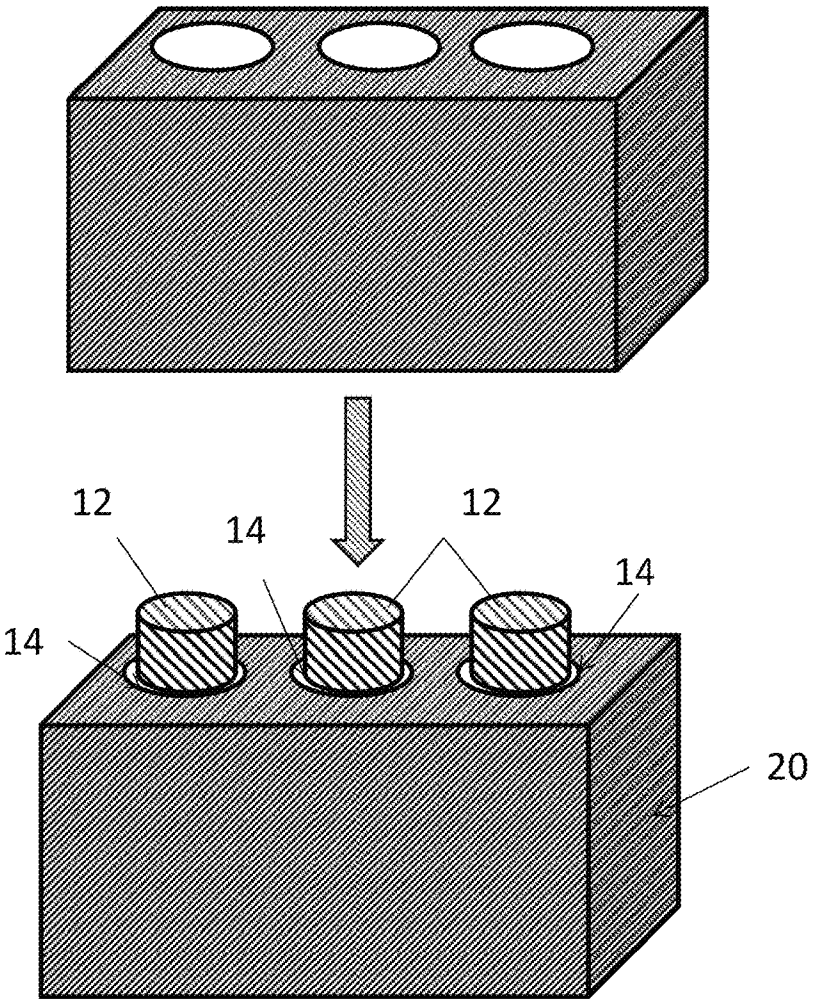
FIG. 4 is a perspective view of another embodiment of the present disclosure.

Referring to FIG. 4, in another embodiment, tungsten carbide body 20, for example, a block, can have a plurality of recesses 14, with each recess receiving a respective superabrasive compact 12. Such an assembly would be useful in wear protection applications. It should be appreciated that multiple compacts 12 may be joined to a single tungsten carbide body 20. As above, upper portions of the compacts 12 can protrude from the tungsten carbide body, with the protrusions being any desired shape. Also, the upper and lower portions can be of the same or different shape. Multiple compacts may be thus joined to the tungsten carbide body in any conceivable pattern and with different shapes.

Figure 5:
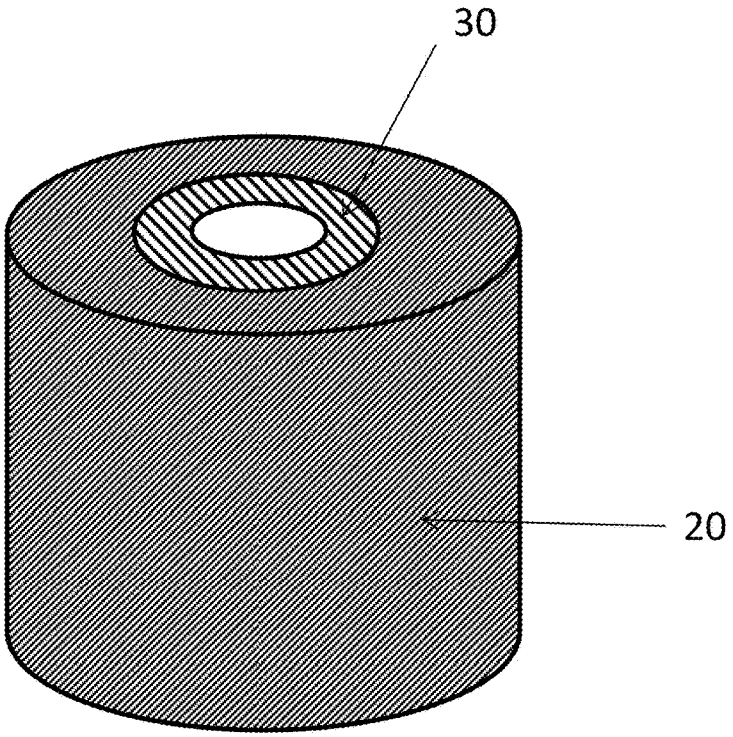
FIG. 5 is a perspective view of another embodiment of the present disclosure.

FIG. 5 illustrates a further embodiment where the superabrasive compact is a hollow cylinder 30. Superabrasive cylinder 30 may be joined to tungsten carbide body 20 and form a liner for a nozzle, whereby the superabrasive compact nozzle make it more abrasion resistant than the tungsten carbide body. This type of assembly may also be useful as a wire die. As above, although not shown, an upper portion of the cylinder can protrude from the tungsten carbide body, with the protrusions being any desired shape.

Figure 6:
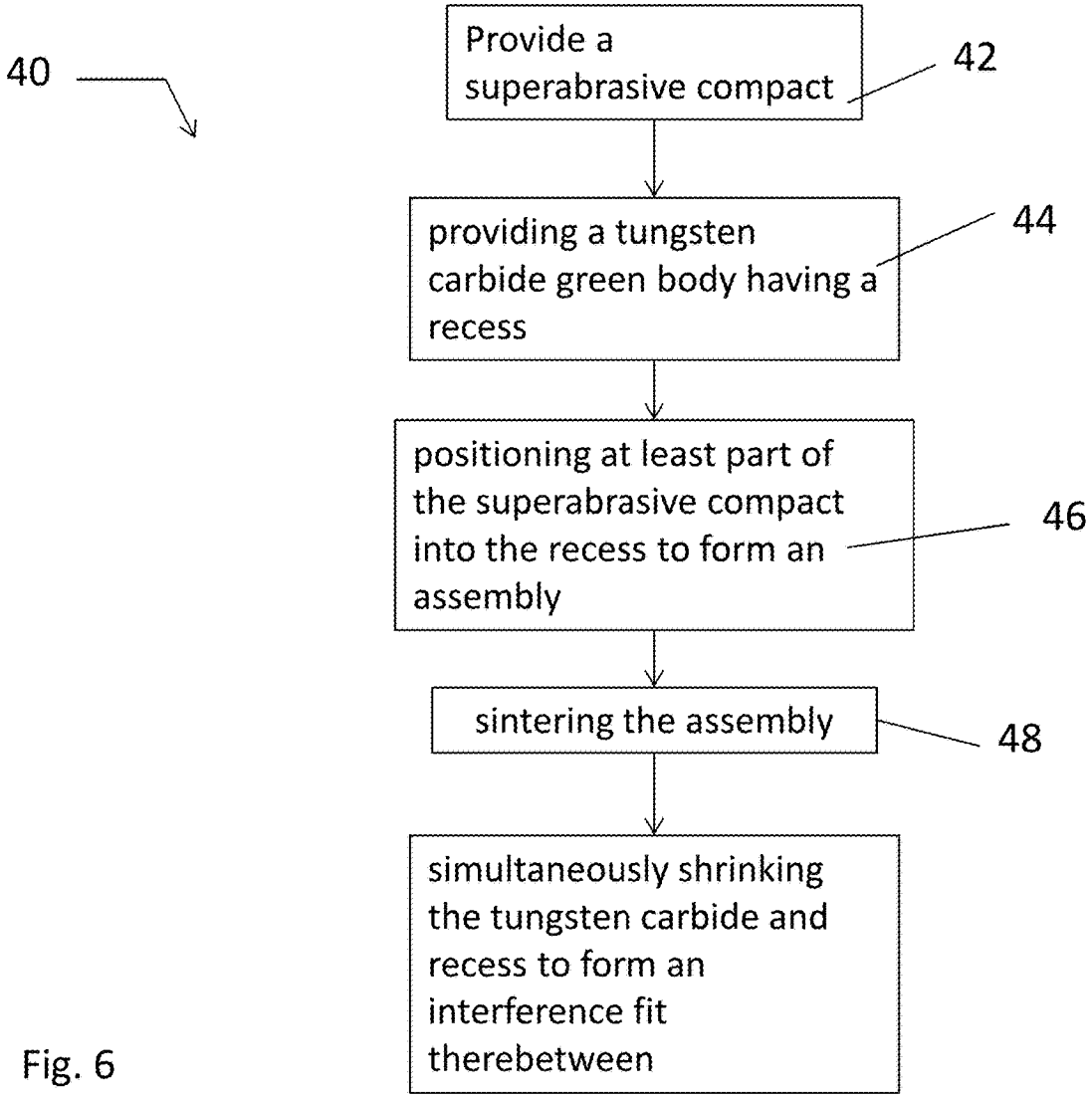
FIG. 6 is a flow diagram illustrating a method of joining a superabrasive compact to a cemented tungsten carbide body.

Referring to FIG. 6, a method 40 of joining at a superabrasive compact to a cemented tungsten carbide body is shown. In step 42 a superabrasive compact is provided. As set forth above, the superabrasive compact can be made of a polycrystalline diamond, polycrystalline cubic boron nitride or silicon carbide diamond bonded composite material. In step 44 a tungsten carbide green body is provided. The tungsten carbide body is a solid 'green body,' containing tungsten carbide particles, cobalt, and an organic binder and formed with at least one recess that is shaped to match the outer profile of at least a part of the superabrasive compact. In step 46, at least a part of the superabrasive compact is positioned within the recess to form an assembly. If the tungsten carbide green body has a plurality of recesses, depending on the tool's end use, a superabrasive compact can be fully or partially inserted into each recess.

The assembly is sintered in step 48 at temperatures up to about 1500° C. The sintering process removes the organic binder and reacts the tungsten carbide particles and cobalt. During the sintering process, the tungsten carbide green body shrinks in a controlled fashion. Thus, rather than attaching the superabrasive compact to the tungsten carbide body in an additional step, in the present method the tungsten carbide body and superabrasive compact are directly joined without the use of any braze alloy or other joining material.

In other words, simultaneously during sintering and as described in step 50, the inner diameter of the tungsten carbide green body will shrink to sinter the tungsten carbide green body such that it forms around at least a part of the superabrasive compact. The shrinkage forms an interference fit of the tungsten carbide around, for example, a volume of the silicon carbide diamond bonded composite, thus eliminating any need for other joining materials. A interference fit of, but not limited to about 0.005 inches to about 0.01 inches evaluated diametrically may be used. The actual size & shape will determine the amount of interference required.

Accordingly, the WC is formed in one step to fit the dimensions of the volume of silicon carbide diamond bonded composite part, thus eliminating the need for any additional step(s) or material to join the components.

Figure 7:
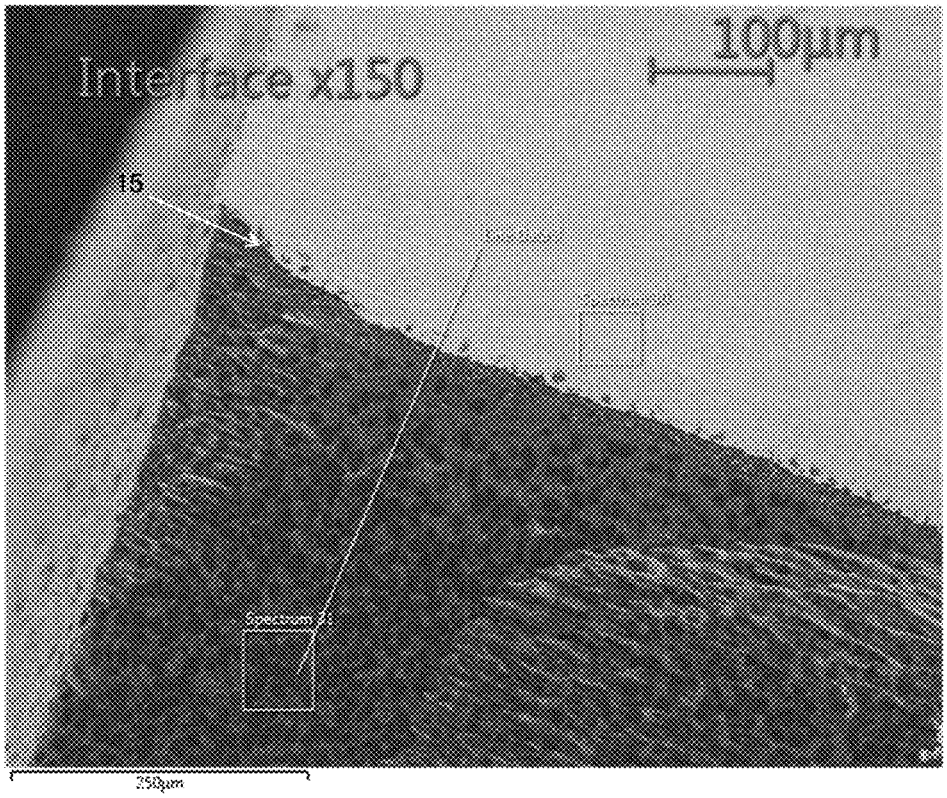
FIG. 7 is an SEM image of the interface between the tungsten carbide body and the silicon carbide diamond bonded material of the superabrasive compact.
Figure 8A:
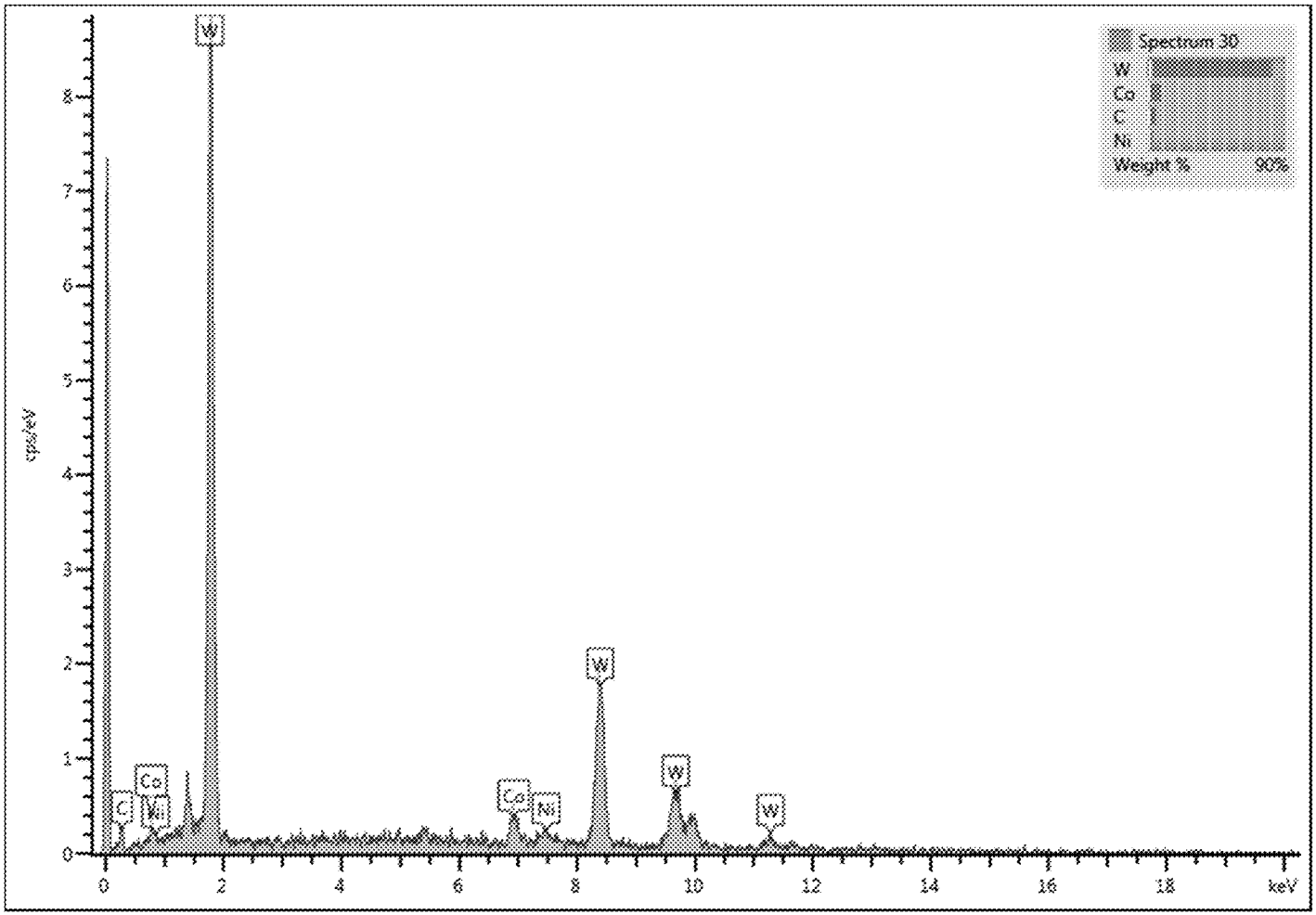
FIGS. 8A and 8B are elemental analysis of the spectrum of the elements that are detected in each of the two boxes of the SEM of FIG. 7.
Figure 8B:
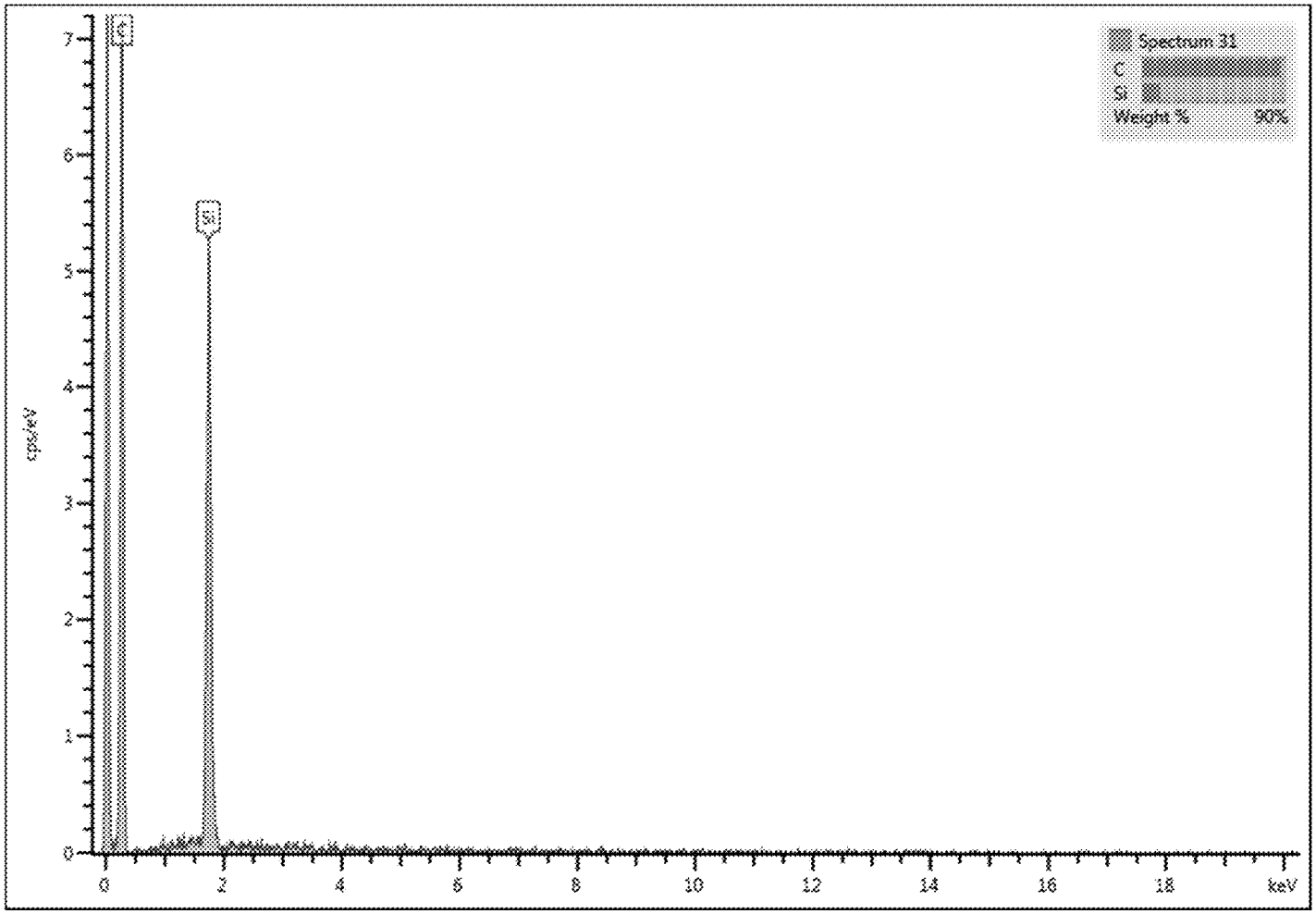

The interface 15 between the tungsten carbide and the silicon carbide diamond bonded composite material is shown in a scanning electron microscope (SEM) image in FIG. 7. The diamond grains show as dark shapes in a matrix of dark gray that is the silicon carbide. The tungsten carbide shows as the lighter colored material. The interface between the two materials is abrupt (i.e., no brazing material is present). Also drawn in FIG. 7 are two boxes labeled Spectrum 30 and Spectrum 31 and a line labeled LineData 3. The elemental analysis, in FIGS. 8A and 8B, shows the spectrum of the elements that are detected in each of the two boxes in FIG. 7. As expected, only W, Co, C, and Ni are detected in the tungsten carbide region and only Si and C are detected in the silicon carbide diamond composite material.

Figure 9A:
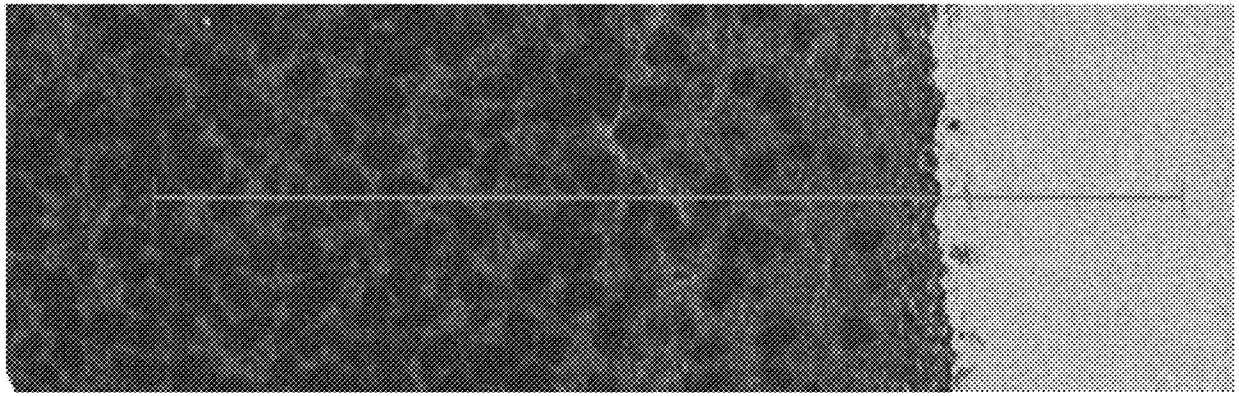
FIG. 9A is an enlarged elemental analysis of the line labeled LineData3 in FIG. 7.
Figure 9B:
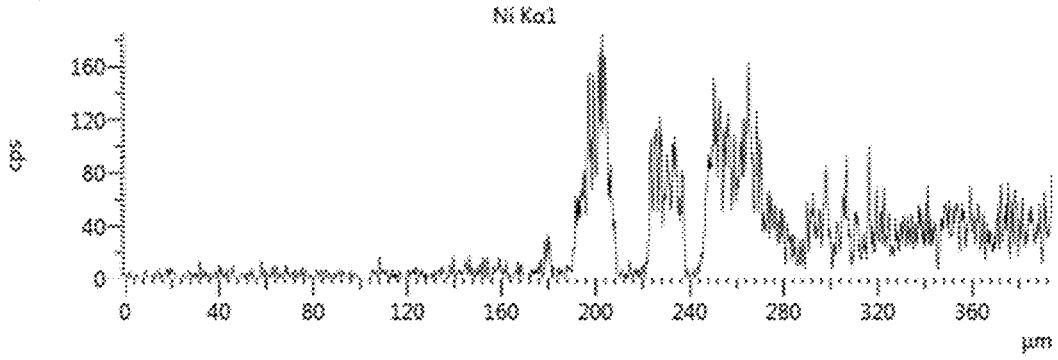
FIGS. 9B-9E are elemental analysis of spectras showing the elements that are detected upon progressing from the silicon carbide diamond composite to the tungsten carbide material of FIG. 7.
Figure 9C:
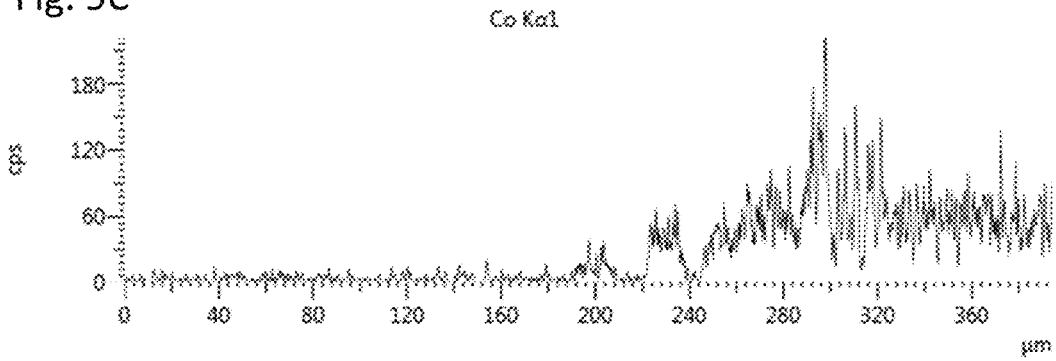
Figure 9D:
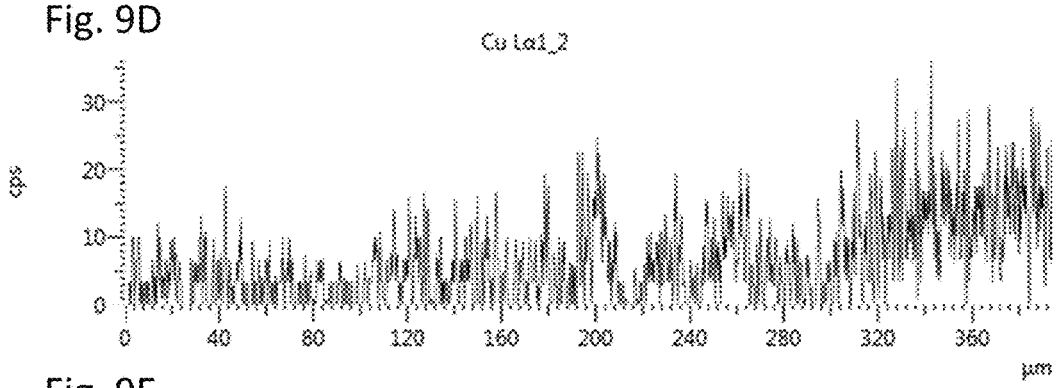
Figure 9E:
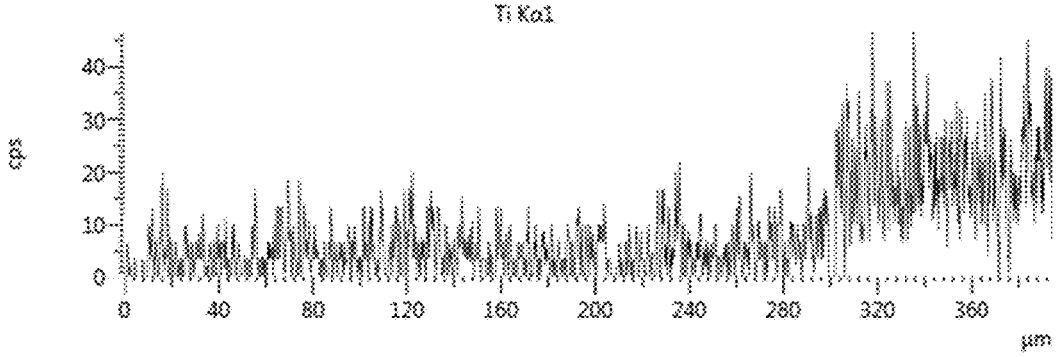

Elemental analysis was also done along the line labeled LineData3 (show again in FIG. 9A). The spectra in FIGS. 9B-9E show the elements that are detected upon progressing from the silicon carbide diamond composite to the tungsten carbide material. For instance, Ni goes from being undetected to being present in significant quantities. The same is true for Co. Again, tracing the line from the silicon carbide bonded diamond to the tungsten carbide, it is seen that Cu and Ti are below detection limits. These two elements are commonly found in braze alloys. Thus, the elemental analysis confirms that the interface is free of any brazing material and that the interface is abrupt.

In contrast, a material that was conventionally bonded using a braze alloy would contain the brazing metal at the interface. And the elemental analysis would show other elements that might be present in the braze, such as titanium, silver, etc.

Figure 10:
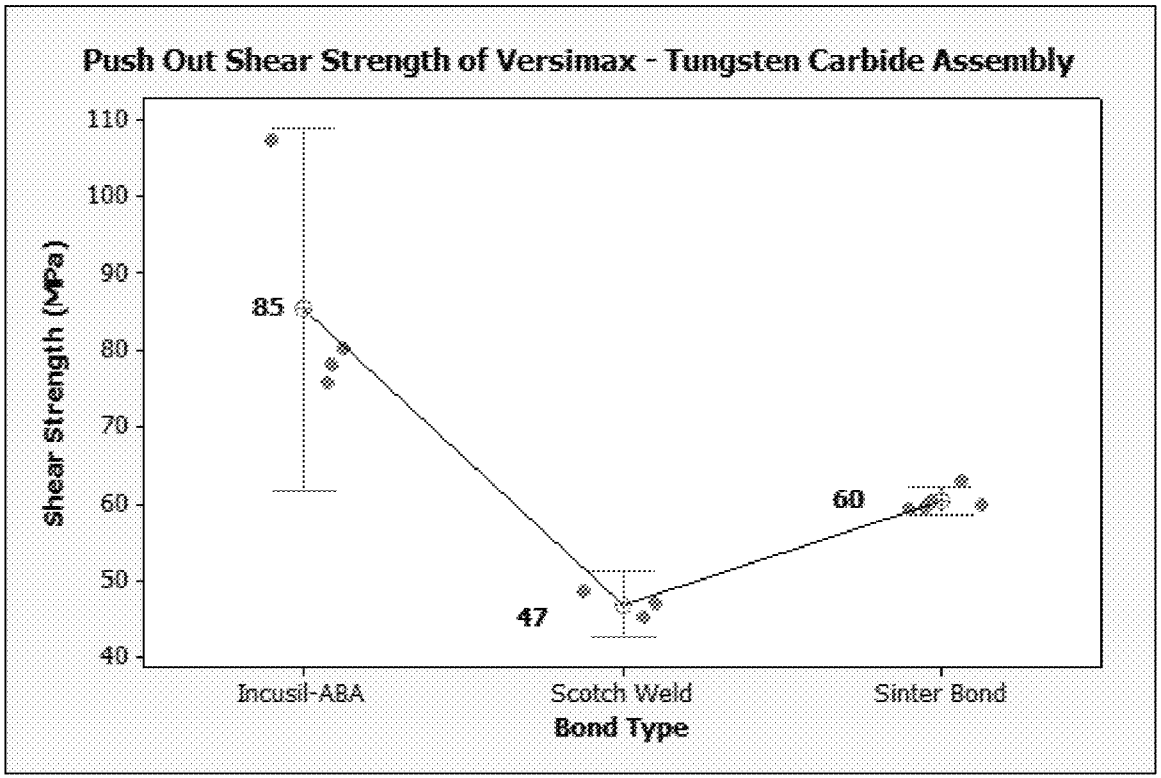
FIG. 10 is a plot of data showing the relative push out shear strengths of different methods used to form the assembly of FIG. 5.
Figure 11:
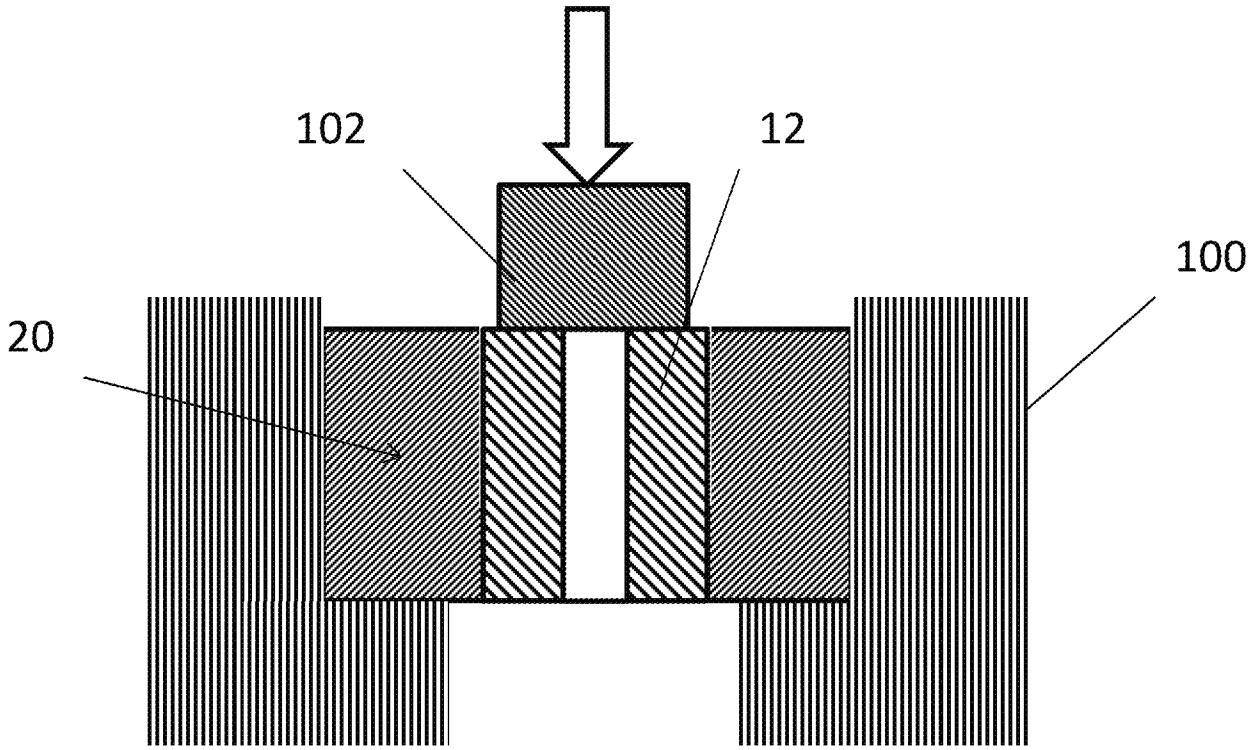
FIG. 11 is a cross-sectional view of a nozzle push-out test setup used to generate the data plot of FIG. 10.

FIG. 10 is a plot of data showing the relative push out shear strengths of different methods used to form the assembly, illustrated in FIG. 5, and FIG. 11 illustrates a testing set-up used for the test, for example, a push-out test setup. Referring to FIG. 11, the assembly of tungsten carbide body 20 and superabrasive nozzle 12 is positioned within a steel support and alignment fixture 100 such that only body 20 is supported by the fixture. A hardened steel pusher 102 is arranged to exert force only on nozzle 12.

Three different assemblies of a tungsten carbide body 20 and a silicon carbide diamond bonded composite nozzle were used. In one bond type a super adhesive (Scotch Weld, 3M, St. Paul, Minn.) was used to join the silicon carbide diamond bonded composite and tungsten carbide. In another bond type the silicon carbide diamond bonded composite was conventionally joined by brazing to the tungsten carbide body with a braze alloy ((Incusil-ABA, Morgan Advanced Materials, Wesgo Metals, Hayward, Calif.), and in the other bond type the present method was used to form a sintered assembly. As shown in FIG. 10, the data shows that the silicon carbide diamond bonded composite and tungsten carbide assembly depicted in FIG. 5 and made by the present method has a similar push out shear strength to the other bonding methods.

However, it should be appreciated that the joining method of the present disclosure is desirable because an adhesive can decompose if exposed to chemicals or heat and brazing results in variable shear strengths, because the braze may not completely fill the join line between Versimax and tungsten carbide. Also, brazing requires heating to high temperatures and under controlled atmosphere. The data shows that the shear strength obtained using the present method C is very consistent over several samples.

While reference has been made to specific embodiments, it is apparent that other embodiments and variations can be devised by others skilled in the art without departing from their spirit and scope. The appended claims are intended to be construed to include all such embodiments and equivalent variations.

What is claimed is:

1. A tool, comprising:

at least one superabrasive compact having an outer profile, the superabrasive compact having a coefficient of thermal expansion and being made of at least one of a polycrystalline diamond, a polycrystalline cubic boron nitride or a silicon carbide diamond bonded composite;

a tungsten carbide body having a coefficient of thermal expansion different from the coefficient of thermal expansion of the at least one superabrasive compact, the tungsten carbide body having a shape that matches at least a part of the superabrasive compact outer profile and being joined to the at least one superabrasive compact by an interference fit, wherein the interference fit between the superabrasive compact and the tungsten carbide body is due to the difference in the coefficient of thermal expansions between the at least one superabrasive compact and the tungsten carbide body; and an interface at the interference fit of the tungsten carbide body and the superabrasive compact, wherein after sintering at the interface only W, Co, C, and Ni are present in the tungsten carbide and only Si and C are detected in the superabrasive compact.

2. The tool of claim 1, wherein the tool is incorporated in at least one of a drill bit, a shear bit, a percussion bit, a roller cone bit, a mining pick, a trenching pick, a road planing pick, an excavating pick, a mill, a hammer mill, a cone crusher, a jaw crusher, and a shaft impactor.

3. The tool of claim 1, wherein the tungsten carbide body has at least one recess for receiving a respective superabrasive compact.

4. The tool of claim 3, wherein only a part of the superabrasive compact is received within the at least one recess of the tungsten carbide body.

5. The tool of claim 3, wherein the tungsten carbide body has a plurality of recesses, each recess receiving a respective superabrasive compact.

6. The tool of claim 1, wherein the superabrasive compact is a nozzle.

7. The tool of claim 1, wherein the superabrasive compact is a wear resistant part.

8. The tool of claim 1, wherein the entire at least one superabrasive compact is received within the at least one recess of the tungsten carbide body.

9. The tool of claim 1, wherein the at least one superabrasive compact has a distal and a proximal end, the proximal end projecting outwardly from the tungsten carbide body.

10. The tool of claim 9, wherein the proximal end has a different shape than the distal end.

11. A method of forming a tool by joining a superabrasive compact to cemented tungsten carbide body, comprising:

providing at least one superabrasive compact having a coefficient of thermal expansion and an outer profile, wherein the superabrasive compact is made of at least one of a polycrystalline diamond, a polycrystalline cubic boron nitride or a silicon carbide diamond bonded composite;

providing a tungsten carbide green body having at least one recess, wherein the recess has a shape complementary to the outer profile of the superabrasive compact, the tungsten carbide green body having a coefficient of thermal expansion different from the coefficient of thermal expansion of the at least one superabrasive compact;

positioning at least part of the at least one superabrasive compact into a respective recess to form an assembly;

sintering the assembly; and simultaneously shrinking the tungsten carbide and recess to form an interference fit therebetween, the interference fit being due to the difference in the coefficient of thermal expansions between the tungsten carbide body and the at least one superabrasive compact, wherein an interface at the interference fit of the tungsten carbide body and the superabrasive compact is formed, and wherein at the interface only W, Co, C, and Ni are present in the tungsten carbide and only Si and C are detected in the superabrasive compact.

12. The method of claim 11, wherein the tool is incorporated in at least one of a drill bit, a shear bit, a percussion bit, a roller cone bit, a mining pick, a trenching pick, a road planing pick, an excavating pick, a mill, a hammer mill, a cone crusher, a jaw crusher, and a shaft impactor.

13. The method of claim 11, wherein the tungsten carbide body includes a plurality of recesses, each recess receiving a respective superabrasive compact.

14. The method of claim 11, wherein only a part of the superabrasive compact is positioned within the at least one recess of the tungsten carbide body.

* * * * *